US011975419B2

(12) United States Patent
Nybacka et al.

(10) Patent No.: US 11,975,419 B2
(45) Date of Patent: May 7, 2024

(54) DUAL MODE POWER TOOL

(71) Applicant: Mirka Ltd, Jepua (FI)

(72) Inventors: Matias Nybacka, Ähtäri (FI); Caj Nordström, Jepua (FI)

(73) Assignee: Mirka Ltd, Jepua (FI)

( * ) Notice: Subject to any disclaimer, the term of this patent is extended or adjusted under 35 U.S.C. 154(b) by 1374 days.

(21) Appl. No.: 16/466,050

(22) PCT Filed: Dec. 9, 2016

(86) PCT No.: PCT/FI2016/050863
§ 371 (c)(1),
(2) Date: Jun. 3, 2019

(87) PCT Pub. No.: WO2018/104577
PCT Pub. Date: Jun. 14, 2018

(65) Prior Publication Data

US 2019/0283202 A1 Sep. 19, 2019

(51) Int. Cl.

| | |
|---|---|
| ***B24B 47/10*** | (2006.01) |
| ***B24B 23/03*** | (2006.01) |
| ***B24B 23/04*** | (2006.01) |
| ***B24B 41/04*** | (2006.01) |
| ***B24B 47/12*** | (2006.01) |
| ***B24B 49/00*** | (2012.01) |

(52) U.S. Cl.
CPC ..... *B24B 23/03* (2013.01); *B24B 23/04* (2013.01); *B24B 41/04* (2013.01); *B24B 47/10* (2013.01); *B24B 47/12* (2013.01); *B24B 49/00* (2013.01)

(58) Field of Classification Search
CPC ..... B24B 41/04; B24B 47/10; B24B 47/12; B24B 23/00; B24B 23/03; B24B 23/04; B24B 23/046
See application file for complete search history.

(56) References Cited

U.S. PATENT DOCUMENTS

| | | | | |
|---|---|---|---|---|
| 3,364,625 | A * | 1/1968 | Sogge | B24B 23/03 451/357 |
| 5,947,804 | A * | 9/1999 | Fukinuki | B24B 23/03 451/344 |
| 9,919,401 | B2 * | 3/2018 | Hsu | B25F 5/001 |
| 2009/0239451 | A1 | 9/2009 | Geiser et al. | |
| 2015/0111480 | A1 * | 4/2015 | Vanko | B24B 47/12 310/50 |
| 2015/0298309 | A1 | 10/2015 | Berdin | |
| 2016/0173015 | A1 | 6/2016 | Sawano | |
| 2017/0252888 | A1 * | 9/2017 | Hsu | B24B 23/028 |

FOREIGN PATENT DOCUMENTS

| | | | |
|---|---|---|---|
| EP | 2366496 | A1 | 9/2011 |
| JP | 2009248290 | A | 10/2009 |
| WO | 2008052434 | A1 | 5/2008 |

OTHER PUBLICATIONS

European Patent Office, Supplementary European Search Report of application No. 16923194.1 dated Jul. 8, 2020, 2 pages.

* cited by examiner

*Primary Examiner* — Chelsea E Stinson
(74) *Attorney, Agent, or Firm* — ArentFox Schiff LLP

(57) ABSTRACT

A power tool includes a grinder, sander or a polisher, which has two working modes. According to an embodiment a dual power tool includes a motor operable in two operational directions, where an operational mode of the dual mode power tool is changeable by changing operational direction of the motor.

17 Claims, 6 Drawing Sheets

DUAL MODE POWER TOOL

PRIORITY

This application is a U.S national application of the international application number PCT/FI2016/050863 filed on Dec. 9, 2016.

TECHNICAL FIELD

The application relates to a dual mode power tool for treating a surface, like a grinder, a sander or a polisher, comprising two working modes.

BACKGROUND

Power tools may be used for different kind of purposes. For example a random orbital sander, is arranged to rotate a sanding pad around a circular path in helical manner against a treated surface. This enables smooth resulting surface, since it avoids single points of abrasive material on a sanding pad travelling the same path twice. While random orbital sander is good for smooth result or finishing, sometimes quicker material removal is desired. For example it may be desired to grind a surface layer away from a product. Depending on the desired end result different kind of operations are desired from power tools.

SUMMARY

It is aim to provide an arrangement for a dual mode power tool without adding complexity to its mechanical structure. This enables providing different functions in one device. The embodiments enable mode change in response to change of operational direction of a motor of a power tool.

According to an aspect of the invention a dual mode power tool comprises a motor operable in two operational directions, wherein a mode of the dual mode power tool is changeable by changing operational direction of the motor.

Mode of operation of a dual mode power tool may be changed in accordance to a change of operational direction of a motor. The tool is suitable for two or more different kind of surface tooling operations.

Function of a power tool is dependent on operation mode, which is selectable in accordance to the operational direction of a motor. A dual mode power tool may function in two different modes. The modes relate to operation or function of the power tool. A mode may comprise functioning as a random orbital sander, as a rotating eccentric sander, as a gear driven eccentric sander, as an orbital sander or according to any other sanding, grinding, polishing or alike function. A dual mode power tool may comprise any combination of two of modes.

BRIEF DESCRIPTION OF DRAWINGS

In the following the embodiments are discussed in more detail with the accompanying figures, of which.

DETAILED DESCRIPTION

A power tool comprises a motor comprising two operational directions, clockwise and counter-clockwise. The power tool comprises two different operation modes, which correspond to two different surface tooling operations. The operation modes of the power tool are dependent on the operational direction of the motor. Function of the machine is changeable by changing rotational direction of the motor. One operational or rotation direction of the motor corresponds to one operation mode of the power tool, and the other operational or rotation direction of the motor corresponds to another operation mode of the power tool. A mode may comprise operation mode of a random orbital sander, a rotating eccentric sander, a gear driven eccentric sander, an orbital sander or any other sanding, grinding, polishing or alike surface tooling operation.

The random orbital sanding operation and an orbital sanding operation enable to provide a smooth resulting surface. A gear driven eccentric sanding operation and a rotating eccentric sanding operation enable to provide rough resulting surface, for example more effective material removal from the surface compared to smooth result via the random orbital sanding or the orbital sanding operations. The gear driven eccentric sanding operation and the rotating eccentric sanding operation may comprise continuous, high speed, simple, rotary sanding operation.

A dual mode power tool according to an embodiment comprises a motor driven shaft, a fixing member for receiving a pad and a locking mechanism. The shaft is drivable by a motor in two operational directions. The fixing member is arranged to rotate with the shaft and configured to be connectable to a pad. The locking mechanism is arranged to engage in one operational direction of the motor and disengage in the other operational direction of the motor. The locking mechanism, when engaged, has effect on spinning of the fixing member.

Figure 1A:
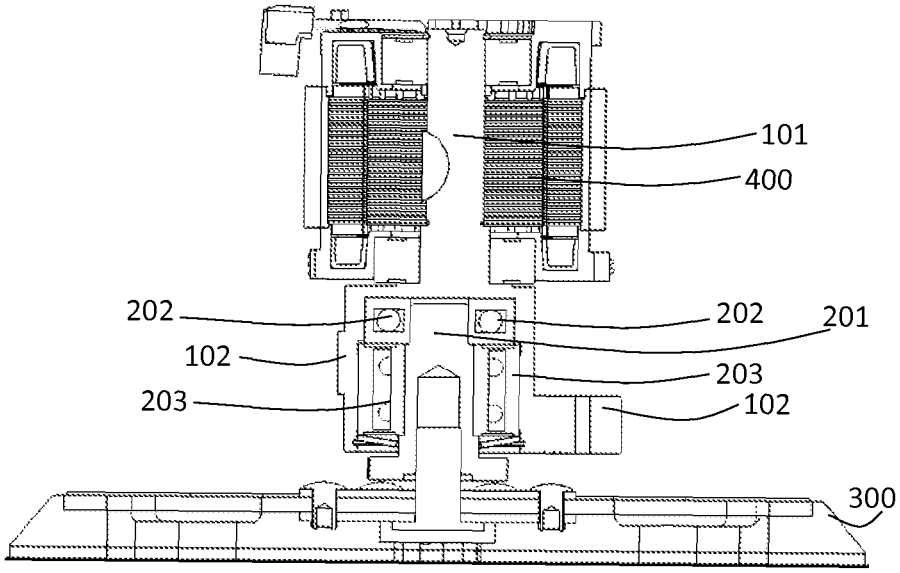
FIG. 1*a* illustrates a side view of a dual mode power tool according to an embodiment of the invention.
Figure 1B:
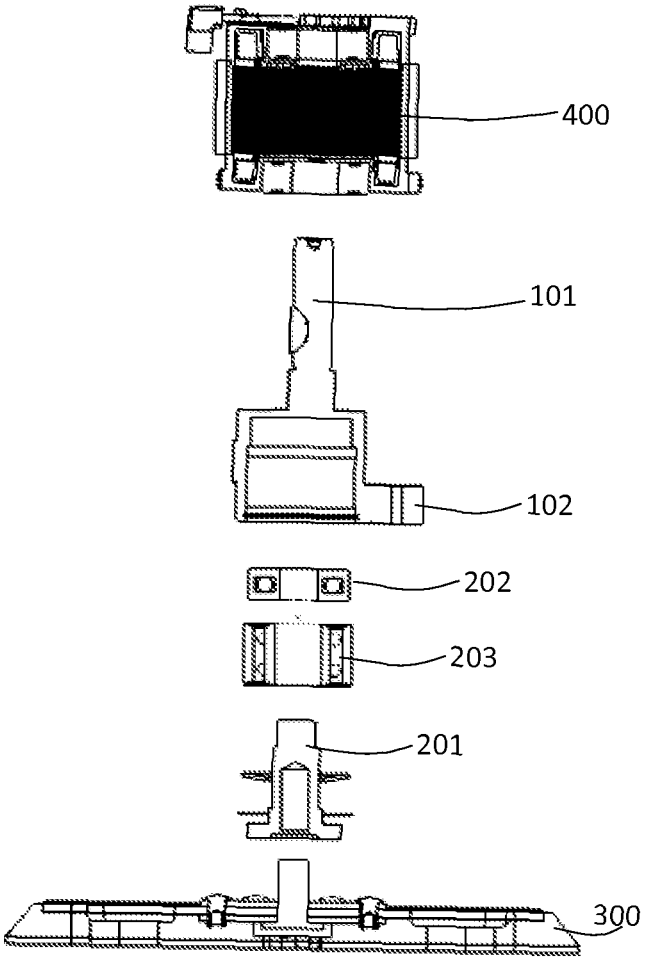
FIG. 1*b* illustrates an exploded view of a dual mode power tool according to an embodiment of the invention.

FIG. 1*a* illustrates a side view of a dual mode power tool according to an embodiment. FIG. 1*b* illustrates an exploded view of a dual mode power tool according to an embodiment. The dual mode power tool comprises a shaft balancer. The shaft balancer comprises a shaft 101 and a balancer part 102. A fixing member 201 is arranged eccentric with a shaft 101. The fixing member may be a spindle. The spindle is connectable to a pad 300. The pad 300 is arranged to receive an abrasive membrane, like a sanding pad, sanding paper or a polishing pad. The abrasive membrane is arranged at a surface of the pad 300 and against a worked surface during use. The abrasive membrane may be detachably attached to the pad 300 mechanically, or via bonding or grip.

The shaft 101 is driven by a motor 400. The shaft may be arranged to join in with shaft of the motor 400. The motor 400 may comprise a brushless direct current (BLDC) motor and a controller for controlling the BLDC motor. The motor 400 may comprise a two directional motor or a three phase motor. The motor is operable in two rotational directions. The motor may be driven in a clockwise direction and in a counter-clockwise direction. The controller is arranged to control operation of the motor, like rotational direction of the motor. The motor 400 is operably connected to the shaft.

The motor 400 is arranged to drive the shaft 101 of the power tool in two operational directions. The controller is arranged to control operational direction of the motor 400. The two rotational directions are arranged to provide two different modes of operation, correspondingly. In a first rotation direction of the motor, the shaft 101 is arranged to move the pad 300 via the fixing member 201 according to a first operation mode. In a second rotation direction of the motor, the shaft 101 is arranged to move the pad 300 via the fixing member 201 according to a second operation mode.

The power tool of the FIGS. 1*a* and 1*b* is arranged to have different operation modes depending on the operational direction of the motor 400. The motor-driven shaft 101 is arranged to move the pad 300 via the fixing member 201. The shaft 101 is arranged to rotate in a direction driven by the motor 400. The fixing member 201 is arranged eccentric in view of the shaft 101. The distance between the shaft 101 and the fixing member 201 is constant. The fixing member 201 is arranged to rotate with the shaft 101. Since the fixing member 201 is arranged eccentrically to the shaft 101, rotation of the shaft 101 causes corresponding rotation of the fixing member 201. A pad 300 is connectable to the fixing member 201. Movement of the fixing member 201 is arranged to be mediated to the pad 300 connected to it. The power tool of FIGS. 1*a* and 1*b* may be used as a random orbital sander and as a rotating eccentric sander.

In a first operational direction of the motor 400, the motor 400 is arranged to drive the shaft 101 in the first rotation or operational direction. The first operational direction corresponds to a first operation mode of the power tool. The operation of the dual mode power tool in the first operation mode corresponds to function of a random orbital sander. The fixing member 201 rotates eccentrically with the motor driven shaft 101. In addition, a bearing 203 enables the fixing member 201 to rotate freely in both rotating directions around spindle axis. The fixing member 201 is arranged to move along circular orbit and in addition to spin randomly around its own axis. A pad 300 is connectable to the fixing member 201. In the first operation mode any point of a pad 300 is arranged to rotate along a circular path in a helical manner.

In a second operational direction of the motor 400, the motor 400 is arranged to drive the shaft 101 in the second rotation or operational direction. The second operational direction corresponds to a second operation mode of the power tool. The operation of the dual mode power tool in the second operation mode corresponds to function of a rotating eccentric sander. The fixing member 201 is fixed eccentric to the shaft 101 and arranged to rotate with the motor driven shaft 101. Free spinning of the fixing member 201 around its own axis is prevented in the second operation mode. This is arranged via locking mechanism comprising a bearing 203 and latch mechanism 202. The locking mechanism is engaged in the second operation mode. Latch mechanism 202 is arranged to lock the fixing member 201 in the second operational direction/in the second operation mode. The latch mechanism 202 is arranged to keep the fixing member 201 in place such that fixing member's 201 spinning around own axis is prevented. The pad is connectable to the fixing member 201. In the second operation mode a point of a pad 300 is arranged to rotate along a circular orbit with the fixing member 201, to which the pad 300 is fixed to.

A locking mechanism 202, 203 is operably connected to the fixing member 201, like a spindle in the FIG. 1*ab*. The locking mechanism is engaged in one operational direction and disengaged in the other operational direction of the motor. The locking mechanism 202, 203 is arranged to enable the spindle to spin around its own axis in one operational direction. The locking mechanism 202, 203 disable the spindle to spin around its own axis in the other operational direction. The locking mechanism 202, 203 may comprise a bearing 203 and a latch mechanism 202. The bearing 203 enables the spindle to spin around its own axis. The latch mechanism 202 is arranged to lock the fixing member 201 to a balancer part 102 of a shaft balancer in one operational direction. The bearing 203 is arranged to keep the spindle in place and the latch mechanism 202 is arranged to prevent the spindle from spinning around its own axis.

The locking mechanism may comprise a one-way switch, a latch, a clutch, a bearing, a clutch bearing, a one-way bearing, a one-way clutch. The latch mechanism 202 may comprise a one-way bearing or a clutch bearing.

The power tool may be used for surface tooling, for example as a grinding tool, a sanding tool or as a polishing tool. The pad 300 may receive an abrasive medium for working/treating a surface. Different kind of abrasive mediums may be attached to the pad 300 depending on desired result for the surface to be worked/treated. Also, the pad 300 may be changed or separate layers may be provided between the pad 300 and an abrasive medium. This may enable providing more/less flexibility and ability to/not conform with shape and contours of the treated/worked surface, as desired.

According to an embodiment, a dual mode power tool of FIG. 1*ab* may be used as a random orbital sander and as a rotating eccentric sander. The same tool is suitable for both just by selecting operation mode, or direction of operation of the motor. The same tool may be used for different purposes and for rough machine-tooling or effective material removal, as well as for fine-tuning, finishing or polishing. The modes of operation according to embodiments are applicable with different operation speeds.

FIGS. 2*a*-2*e* illustrate example motion of any point of a pad during sanding operation mode. FIGS. 2*a*-2*e* are possible examples and there may be different alternatives due to random rotation and/or way of use.

Figure 2A:
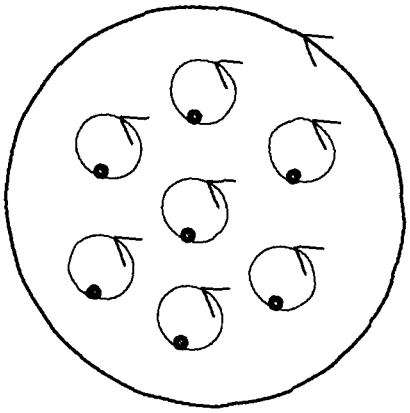
FIG. 2*a* illustrates motion of any point of a pad during orbital sanding.

FIG. 2*a* illustrates motion of any point of a pad during orbital sanding. In an orbital mode the fixing member is restricted from rotating around its own axis. The pad may be restricted from rotating, for example by an elastomeric element. Any point of a pad is arranged to move in small orbits or circles. Orbital mode enables fine sanding operation.

Figure 2B:
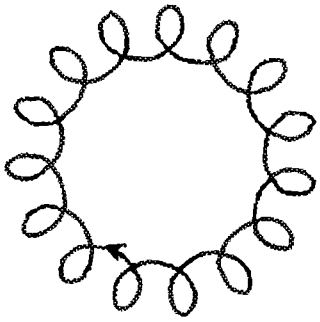
FIG. 2*b* illustrates motion of a point of a pad during random orbital sanding.

FIG. 2*b* illustrates motion of any point of a pad during random orbital sanding motion of a pad. In action random orbital sander may move a point of a sanding pad along a circular path with a helical pattern. A random orbital sanding operation mode comprises pad rotation via a fixing member, where the fixing member is arranged to rotate and spin around its own axis. Any point of a pad may be arranged to move along hypocycloidic path with random ratio between orbit and rotational frequency. The fixing member is arranged eccentric in view of the motor-driven shaft. In addition, the fixing member is allowed to spin around its own axis. The fixing member is spinning due to friction force caused by the orbital movement. The fixing member may spin randomly at both directions. Any point of a pad may move along a tiny orbit, which may tend to stretch into longish curved loops. The curved loops may tend to interlace.

The free, random movement in accordance to corresponding spinning of the fixing member is affected by imperfections of a surface, a pad and/or an abrasive medium. Different frictions zones have effect on spinning. A point of a pad is outcome of mixing the two circular motions. The movement may be called epicycloid. Smaller circles may form tight overlapping circles or separate circles next to each other, or some space between them. Tightness of the loops is dependent on circumstances during tooling. Due to random movement and overlapping paths of pad points, the random orbital sanding mode enables providing fine finished surface.

Figure 2C:
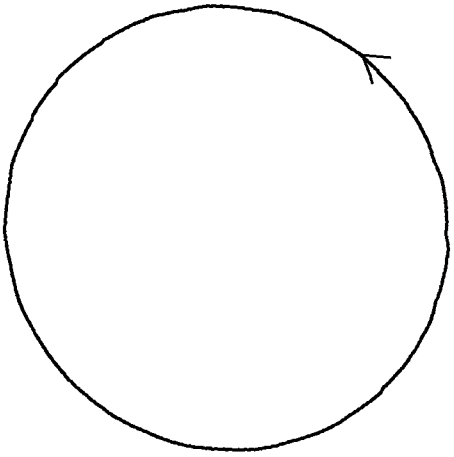
FIG. 2*c* illustrates motion of a point of a pad during rotating eccentric sanding.

FIG. 2*c* illustrates motion of a point of a pad during rotating eccentric sanding motion of a pad. A point of the pad rotates in unison with a fixing member. Locking means are engaged and free rotation of the fixing member around its own axis is prevented. The fixing member is arranged to rotate eccentric with the motor driven shaft. One rotating circle of a shaft corresponds to one rotating circle of the fixing member and one rotating circle of a point of the pad. Any point of a pad is arranged to move along a fixed circle.

Figure 2D:
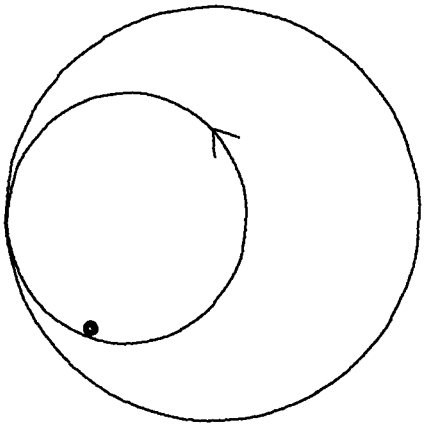
FIG. 2*d* illustrates motion of a point of a pad during gear driven eccentric sanding.
Figure 2E:
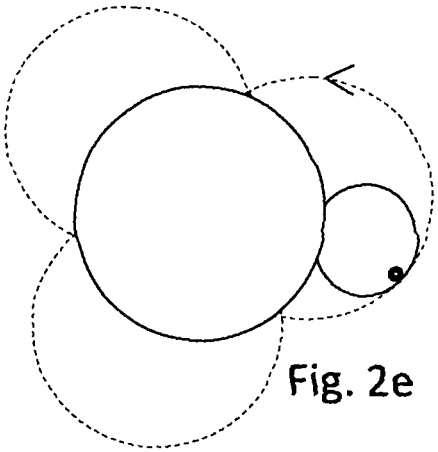
FIG. 2*e* illustrates motion of a point of a pad during gear driven eccentric sanding.

FIGS. 2*d* and 2*e* illustrate motion of a point of a pad during gear driven sanding. In a gear driven sanding operation mode fixing member is forced or locked next to a gear. The fixing member may be arranged to move along internal geared circle periphery, as illustrated in the FIG. 2*d*, or along external geared circle periphery, as illustrated in the FIG. 2*e*. Fixing member has smaller diameter compared to the geared periphery, towards which it is engaged via gears. The fixing member rotates along geared periphery. In addition to the circular geared periphery, fixing member spins around its axis along geared periphery. Spinning of the fixing member is regular along gears. A point of a pad spins several times during one full rotation of the point of the pad. In the FIG. 2*d* the fixing member having smaller diameter compared to the outer gear ring, rolls next to and around the inner circle periphery of an outer gear ring. The movement of a fixed point of a pad may be called hypocycloid. In the FIG. 2*e* the fixing member having smaller diameter compared to the gear ring, rolls next to and around the external circle periphery of an inner gear ring. The movement of a fixed point of a pad may be called epicycloid.

Arrows show an example direction of movement in the FIGS. 2*a-e*. The direction of movement may be the opposite. The rotation is possible in the two opposing rotation directions. Scale and shape of illustrated paths in the FIGS. 2*a-e* may differ from the illustrated. For example, smaller inner loops of FIG. 2*b* may comprise different number of loops, be in more tight arrangement, comprise overlapping loops, and/or the loops may approach ellipse form or comprise partly straight lines instead of circular/orbital form.

The motor for driving a shaft of a power tool may comprise a brushless direct current (BLDC) motor. BLDC motor comprises a permanent magnet synchronous motor comprising a rotor and stator coils. BLDC motor comprises permanent magnets which rotate around a fixed armature. BLDC motor is powered by direct current (DC) via inverter or switching power supply coupled to bidirectional alternating current (AC) source. There are no connecting current for moving armature, nor windings on rotator in a BLDC motor. Brush or commutator is replaced by electronic controller, which is arranged to switch phase to windings to keep motor turning. A controller is arranged to direct rotation of a rotor. Rotation of a rotor determines rotor orientation or position relative to stator coils. Two coils are activated at a time with equal opposite polarities. One of the activated coils is arranged to push a rotor away and another to attract the rotor towards it. The controller may comprise an electronic controller, software, a microcontroller, a microprocessor, hardware analogue or a digital firmware with an integrated circuit, like a field programmable gate array (FPGA).

BLDC motor is controlled by controller, which may comprise electronics and software. Electronics may be arranged to execute software instructions, which are arranged to control the operation of the motor. The software comprises executable instructions for controlling a rotation direction of the motor. Direction of the rotation of the motor may be altered by a software, when executed. A dual mode power tool according to embodiments is implementable without any changes to the control electronics of the motor.

Figure 3A:
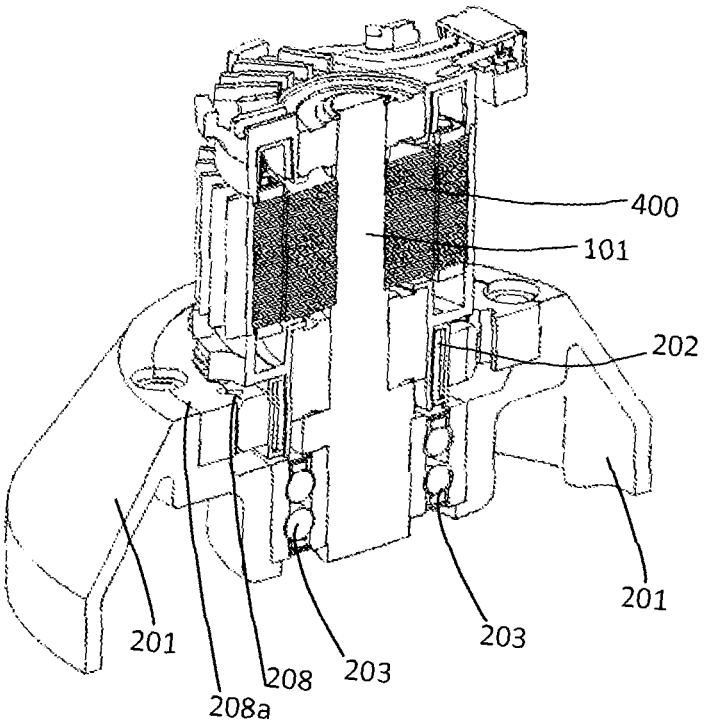
FIG. 3*a* illustrates a dual mode power tool according to an embodiment of the invention.
Figure 3B:
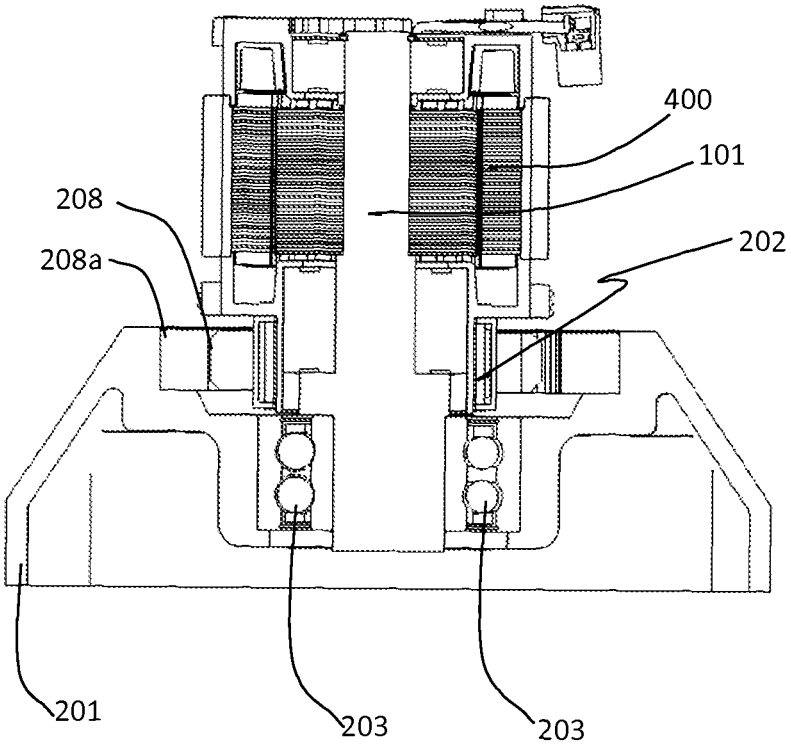
FIG. 3*b* illustrates a side view of a dual mode power tool according to an embodiment of the invention.

FIG. 3*a* illustrates a dual mode power tool according to an embodiment. FIG. 3*b* illustrates a side view of a dual mode power tool according to an embodiment. The power tool of FIGS. 3*a* and 3*b* comprises a shaft balancer comprising a shaft 101, which is arranged to be driven by a motor 400. The shaft 101 may be driven in two opposing operational directions. Rotation of the shaft 101 causes corresponding movement of a fixing member 201 due to the offset of the shaft. The fixing member 201 in the FIG. 3*ab* may comprise a casing structure. The fixing member 201 is configured to be connectable to a pad. The fixing member 201 is arranged to rotate with the motor driven shaft 101 via a bearing 203. A bearing 203 may be provided around or next to a fixing member 201. The bearing 203 enables spinning of the fixing member 201 around its own axis. A latch mechanism 202 may be arranged to engage locking mechanism in one operational direction. The bearing 203 enables the fixing member to rotate in both directions. A latch mechanism 202 is arranged to lock gear rim 208 in one operational rotating direction. The latch mechanism 202 may be a clutch bearing, a needle bearing or a sliding bearing arranged to enable rotation in one direction only. In the FIG. 3*ab* the latch mechanism 202 is arranged to engage the gear rim 208 to the motor 400. The FIG. 3*ab* show gear connection 208*a* of gears of the fixing member 201 and gears of a gear rim 208 connected to the motor through the latch mechanism 202.

The dual mode power tool of FIG. 3*ab* comprises operation modes of random orbital sanding and gear driven eccentric sanding. During random orbital sanding the fixing member 201, as well as a pad attached to it, is arranged to rotate and spin around its own axis. The fixing member 201 is driven by the motor 400 via the shaft 101. In the random orbital sanding mode a latch mechanism 202 is disengaged. In order to change mode of operation in response to operational direction of the motor 400, the latch mechanism 202 of the FIG. 3*ab* is engaged. The latch mechanism 202, when engaged, is arranged to lock outer gear 208 raceway to alter mode to the gear driven eccentric sanding mode. In the gear driven eccentric sanding mode latch mechanism 202 is arranged to lock the gear 208 to the power tool housing. In this mode the fixing member is rotating along gears of the internal geared periphery of the housing of the power tool.

In another embodiment a power tool according to FIG. 3*ab* may be engaged and disengaged via mechanical movement. The gears may be configured to move in relation to each other such that the gears are arranged to engage with each other in one operation mode and disengage in the other operation mode. The movement may be arranged along a thread, for example.

When locking mechanism is disengaged, a fixing member is arranged to rotate freely around its own axis. When locking mechanism is engaged, gear rim is arranged to be locked to a housing and the fixing member is forced to rotate with ratio between housing rim gear and gear on the spindle around its own axis. The power tool of FIG. 3*ab* comprises modes of a random orbital sanding and a gear driven eccentric sanding, the latter being the engaged mode or direction. Gear driven sanding mode comprises forced orbital sanding, where a gear mechanism may function as a hypocycloidal reduction drive or as a cycloidal speed reducer.

Locking mechanism may lock the gear rim of the fixing member to the power tool housing so that the fixing member will follow an epicycloid or hypocycloid motion, when a motor of a power tool is driven in one operational direction.

Figure 4:
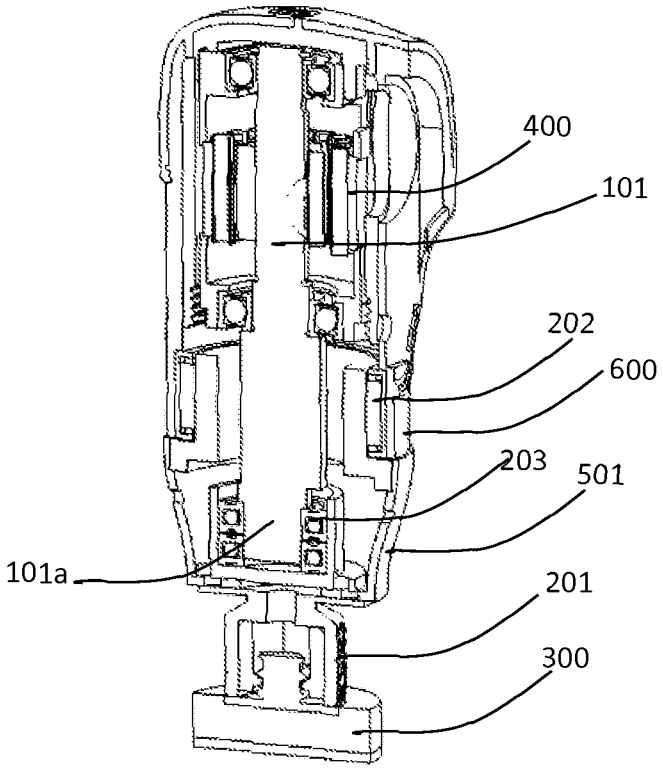
FIG. 4 illustrates a dual mode power tool according to an embodiment of the invention.

FIG. 4 illustrates a dual mode power tool. The dual mode power tool of FIG. 4 may function as a random orbital sander and as an orbital sander. The mode of operation is dependent on operational direction of a motor. A pad 300 is connected to a fixing member 201. The fixing member 201 may be a spindle. A shaft 101 is arranged to conjoin with the motor 400 axle. Motor 400 drives the shaft 101. The shaft 101 may be rotated in two opposing rotation directions, as driven by the motor 400. The shaft 101 may comprise an eccentric portion 101*a*. A bearing 203 is arranged next to an eccentric portion 101*a* of the shaft. A bearing 203 enables the shaft 101 to rotate in two directions. A bearing 203 is arranged to enable free movement of the spindle 201 in one operational direction. The power tool of FIG. 4 comprises elastomeric member 501 fixed to the fixing member 201 and to the power tool housing 600, and surrounding a portion of the shaft 101. The elastomeric member 501 may form part of external housing of the power tool, with the solid, fixed power tool housing 600. A locking mechanism 202 is arranged between the elastomeric member 501 and the housing 600, inside the power tool external housing. The power tool external housing may comprise a housing 600, an elastomeric member 501 and/or another housing element forming external appearance of the power tool. Locking mechanism 202 may comprise a bearing, which may be a needle bearing. In one operational direction the elastomeric member 501 is able to rotate freely. A locking mechanism 202 is disengaged. This corresponds to random orbital mode of the power tool. In the opposing operational direction the locking mechanism 202 is engaged and elastomeric member 501 is prevented from rotating, while only motor 400 driven shaft 101 mediates its movement via bearing 203 and fixing member 201 to the pad 300. This mode corresponds to the orbital sanding. The elastomeric member 501 may comprise polymer, rubber or other material.

A dual mode power tool may comprise a motor 400 operable in two rotation directions, wherein a surface tooling operation mode of the dual mode power tool is changeable by changing rotation direction of the motor; and the dual mode power tool may comprise a locking mechanism, wherein the locking mechanism is arranged to engage an elastomer member 501 fixed to the fixing member 201 in one operational rotation direction, and wherein the locking mechanism 202 is arranged to disengage the elastomer member 501 fixed to the fixing member 201 in the other operational direction.

A pad is fixed to a fixing member. The pad is moved in unison with the fixing member.

Operation mode of a dual mode power tool according to embodiments may be selected by selecting rotation direction of a motor of the dual mode power tool. In accordance to the driving direction of the motor, a shaft is rotated in the selected direction. The shaft mediates the rotation to the fixing member, which is arranged to rotate a pad fixed to it. A power tool according to embodiments comprises mechanism for activating a selected operation mode by a user. Activation provides indication to the controller for controlling the motor accordingly. Instead of adding extra knobs, or other mechanical means, existing controller may be employed for activating a desired mode. For example, speed controller or a power controller may be used for selecting an operation mode. Generally any existing lever or alike controller may be utilized. A lever may be triple-clicked in order to change an operation mode. There may be a pre-determined push combination or number of clicks pre-determined as an input for activating an operation mode. In addition, some indication of current mode may be presented. This may be implemented using existing indication marks, like led lights or alike.

In response to receiving an indication for activating a certain operation mode, the controller is arranged to execute the corresponding software block via electronics arranged to control the motor. The software is activated based on predetermined indication and it may comprise means for activating indication of the current mode, like a light. In response to receiving an indication to change the operation mode, or rotation direction of the motor, the controller are arranged to slow down the rotation speed of the motor, before implementing change of the rotation direction.

A dual mode power tool according to an embodiment may be used for different operations, for example as a grinder, as a sander, as a random orbital sander, as a polisher or as any other surface tooling tool. According to an embodiment a dual mode power tool functions as any two of an orbital sander, a random orbital sander, a rotating eccentric sander, a gear driven eccentric sander, or any other sander. Various kinds of surface treatment/finishing are possible with a dual operation modes of a power tool. Different kind of attachable working pads may be utilized for a desired purpose and operation modes. Operation is possible with any speed of operation.

In accordance to an aspect of an invention, no mechanical manipulation is necessary for changing mode of operation of the dual mode power tool.

An embodiment may provide an effect of providing a dual mode power tool comprising simple structure. An embodiment may have effect of enabling different working modes without complicated mechanics. This enables providing a durable power tool, keeping costs low and maintaining easy. The power tool according to embodiments is easy to handle and use. The mode of operation is quick and easily changeable. Manufacturing is kept cheap due to possibility to use standard parts and elements. Further, methods and production lines for manufacturing dual mode power tools may be kept simple without complicated additions, since no complicated changes are made to mechanical parts.

Mode of operation or surface tooling operation modes may comprise at least two of random orbital sanding mode, orbital sanding mode, rotating eccentric sanding mode, forced sanding mode and gear driven eccentric mode.

A power tool according to at least some/all embodiments may be a hand held power tool. A power tool according to at least some/all embodiments may comprise a robotically operable power tool. A dual mode power tool may be a drivable tool or a ride on tool instead of a hand held tool. A drivable tool or a ride on tool may be used for surface tooling for bigger areas, for example for a floor surface tooling.

The embodiments and examples illustrated in the application are aspects of the invention. Those shall not be limiting, but changes may be made, parts may be added, removed or replaced with each other or alternative parts suitable for the dual mode power tool.

The invention claimed is:

1. A dual mode power tool comprising:

a motor operable in two rotation directions, a shaft driven by the motor, a fixing member arranged eccentrically to the shaft, a bearing enabling rotation of the fixing member around its own axis, a gear rim, a gear connection of gears of the fixing member and gears of the gear rim, a locking mechanism, and a housing, wherein the fixing member is connectable to a pad, wherein a surface tooling operation mode of the dual mode power tool is changeable by changing rotation direction of the motor; wherein the locking mechanism is arranged to engage the gear rim to the housing in one rotation direction so as to force the fixing member to rotate around its own axis with a ratio between the gears of the gear rim and the gears of the fixing member, and wherein the locking mechanism is arranged to disengage the gear rim from the housing in the other rotation direction so that the fixing member is arranged to rotate freely around its own axis.

2. The dual mode power tool according to claim 1, further comprising a shaft balancer comprising the shaft.

3. The dual mode power tool according to claim 2, wherein the shaft is arranged to conjoin a rotation axle of the motor.

4. The dual mode power tool according to claim 1, wherein the locking mechanism includes at least one of: a latch mechanism, a one-way switch, a latch, a clutch, a bearing, a clutch bearing, a one-way bearing or a one-way clutch.

5. The dual mode power tool according to claim 1, wherein the locking mechanism is arranged to enable the fixing member to rotate with the shaft and spin around its own axis in one rotation direction; and wherein the locking mechanism is arranged to enable the fixing member to rotate along gears of an internal geared periphery of the housing of the power tool in the other rotation direction.

6. The dual mode power tool according to claim 1, wherein the pad is attached to the fixing member, wherein motor driven rotation of the shaft is arranged to be mediated to the pad via the fixing member.

7. The dual mode power tool according to claim 1, further comprising an electronic controller for controlling operation of the motor in two rotation directions, the two rotation directions being clockwise and counter-clockwise.

8. The dual mode power tool according to claim 1, wherein the dual mode power tool is constructed for one or more of surface tooling, grinding, sanding, polishing or surface finishing.

9. The dual mode power tool according to claim 1, comprising surface tooling operation modes of random orbital sanding mode and gear driven eccentric mode.

10. The dual mode power tool according to claim 1, wherein the pad is arranged to receive a detachably attachable abrasive medium.

11. The dual mode power tool according to claim 1, wherein the motor is a brushless direct current motor (BLDC).

12. The dual mode power tool according to claim 1, wherein the two operational rotation directions are operable at any operation speed of the dual mode power tool.

13. The dual mode power tool according to claim 1, wherein the dual mode power tool comprises a hand-held dual mode power tool.

14. The dual mode power tool according to claim 1, wherein the dual mode power tool comprises a robotic driven dual mode power tool, or a drivable dual mode power tool, or a ride on dual mode power tool.

15. The dual mode power tool according to claim 1, wherein the locking mechanism includes a latch mechanism, wherein the latch mechanism is arranged to engage the gear rim to the motor.

16. The dual mode power tool according to claim 1, wherein the locking mechanism includes a latch mechanism, wherein the latch mechanism is arranged to lock the gear rim in one operational rotating direction.

17. The dual mode power tool according to claim 1, wherein the locking mechanism includes a latch mechanism, wherein the gear connection of the gears of the fixing member and the gears of the gear rim are connected to the motor through the latch mechanism.

* * * * *